United States Patent [19]

Praner

[11] 4,417,859

[45] Nov. 29, 1983

[54] ROTARY DISPLACEMENT TURBINE ENGINE WITH VACUUM RELIEF VALVE MEANS

[76] Inventor: Frank C. Praner, Rte. 2, Box 527, Fairhope, Ala. 36532

[21] Appl. No.: 81,820

[22] Filed: Oct. 4, 1979

[51] Int. Cl.[3] ..... F04B 49/02; F01C 1/12; F01C 19/00; F01C 21/00

[52] U.S. Cl. ..... 417/310; 418/81; 418/141; 418/183; 418/191

[58] Field of Search ..... 418/15, 81, 141, 183, 418/189, 191, 196; 417/310

[56] References Cited

U.S. PATENT DOCUMENTS

| | | | |
|---|---|---|---|
| 675,353 | 5/1901 | Hoffman | 418/196 |
| 771,933 | 10/1904 | Putnam | 418/191 |
| 802,828 | 10/1905 | Smith | 418/81 |
| 820,447 | 5/1906 | Thomas | 418/189 |
| 939,729 | 11/1909 | Marks | 418/196 |
| 974,803 | 11/1910 | Lukacsevics | 418/141 |
| 1,023,360 | 4/1912 | Brauer | 418/189 |
| 1,319,456 | 10/1919 | Bingham | 418/191 |
| 1,520,242 | 12/1924 | Holmes | 418/15 |
| 3,684,413 | 8/1972 | Hinckley | 418/141 |

FOREIGN PATENT DOCUMENTS

| | | | |
|---|---|---|---|
| 288420 | 4/1928 | United Kingdom | 418/15 |

*Primary Examiner*—John J. Vrablik
*Attorney, Agent, or Firm*—Remy J. VanOphem

[57] ABSTRACT

An external combustion engine is disclosed of the type including two or more circular rotors rotatably supported, one of the rotors acting as a power rotor and rotating in tangential contact with the other sealing rotor. The power rotor is formed with a radially projecting piston passing into a mating recess with the sealing rotor at a corresponding circumferential location. Steam or other working fluid is admitted via an intake port located opposite one face of the power rotor to cause rotation of the power rotor by expansion of the fluid in a working chamber defined by the space behind the piston. As the power rotor continues to rotate, the working chamber passes into communication with an exhaust port preparator to another power stroke. A vacuum relief port is provided at an intermediate location which relieves any vacuum condition which develops behind the piston during part throttle operating conditions of the engine. A pressure balancing groove is located on a face of the power rotor and pressurized with working fluid to balance the pressure acting on the power rotor by the location of the intake port on the opposite face of the power rotor. An absorber chamber is provided downstream of the throttle valve and upstream of the intake port to smooth out the pressure forces created by intermittent flow of fluid through the intake port. An elliptical port throttle valve design is disclosed which minimizes the wire drawing effect of the working fluid acting on the valve member during operation of the valve. A special rotor sealing surface treatment is disclosed comprising a series of slight depressions or holes formed in the mating faces of the power rotor and which generate a sealing due to condensation of the escaping steam in the surface indentations. Two and three rotor versions of the engine are described as well as one, two, and four power stroke per revolution embodiments.

13 Claims, 9 Drawing Figures

ROTARY DISPLACEMENT TURBINE ENGINE WITH VACUUM RELIEF VALVE MEANS

BACKGROUND DISCUSSION

It has heretofore been described in the prior art to provide rotary engines of the type including two or more tangentially contacting rotors, a power rotor and a sealing rotor, which rotate about parallel axes with their peripheral surfaces in tangential contact. The power rotor is formed with a protuberance or piston extending outwardly into a chamber defined by a surrounding housing bore within which is mounted the power rotor. A corresponding pocket or recess is formed on the sealing rotor so that as the piston rotates about and into engagement with the sealing rotor, the piston is received within the recess. A working fluid under pressure is introduced through intake porting into the space behind the piston and ahead of the point of contact of the rotors such as to cause rotation of the power rotor by expansion of the working fluid, producing a force acting on the power rotor tending to produce rotation. At the end of the expansion stroke, the piston moves past an exhaust port, allowing exhausting of the fluid prior to initiation of another cycle.

This design has many advantages, i.e., simplicity; the relatively small number of working parts of simple and rugged construction; freedom from vibration since the working parts undergo only rotation; and a relatively efficient thermodynamic cycle in which relatively complete expansion of the working fluid is enabled. In the case of steam as a working fluid, the relatively complete expansion thereof largely obviates the necessity for a large condenser, since the steam is largely condensed upon being exhausted from the working chamber.

However, despite these advantages, several problems are associated with this design. Among these are the rapid valving action occurring tends to produce large accelerating and decelerating forces due to the rapid valving action necessary in controlling the admission of the working fluid. Again, the valving action may involve the use of valving ports formed on a cover plate or other similar structure disposed adjacent one face of the power rotor with a corresponding valving recess moving into registry with the valve port at the appropriate point in the cycle of the power rotor rotation. This creates a tendency for the working fluid pressure to be exerted on one face creating a pressure force acting on the rotor tending to increase the friction forces, reducing the efficiency, durability and reliability of the engine.

A further difficulty that may be encountered under part throttle conditions is that as the piston rotates to a point intermediate the location where the exhaust port is located, the working fluid may be expanded to the point whereat a subatmospheric or vacuum pressure is created in the working chamber behind the piston. This creates a drag acting on the rotor, working against a pressure differential between atmospheric pressure and the pressure behind the piston. Similarly, a vacuum condition can develop just at the point whereat the piston exits the recess, creating a further drag on the engine, tending to reduce its overall operating efficiency.

Another major difficulty has been associated with the necessity to produce a face seal on the rotor face and adjacent cover plate structure in order to prevent bypassing leakage of the working medium past the mating faces thereof. Such seals must be extremely durable, relatively effective, and not be subject to wear such as to create substantial maintenance burdens associated with operation of the engine. Again, the cost of the seal must be moderate in order to achieve the overall objectives of the design of relatively low cost and simple configuration.

Associated with such fluid pressure devices is a problem defined as a wire drawing effect typically experienced with a throttle valve, that is, the fluid pressure acting on the valving member as the opening and closing of a valve port produces losses in the system in flowing through a small orifice. Also, fluid pressure acting on the valving tends to force it into extremely tight engagement with the port face increasing the wear and effort required in operating the throttle valve. On the other hand, the fluid pressure forces are generally relied on in order to produce a good sealing contact with a valve member in the valve port face.

Accordingly, it is an object of the present invention to provide a displacement turbine engine of the general type described but in which the pressure surges due to the operation of the valving means must be relied on to control the admission of the working fluid pressure to the working chamber.

It is a further object of the present invention to provide such displacement turbine engine in which the pressure unbalance forces acting on the power rotor are largely avoided even though valving consisting of ports located on one face of the power rotor are employed to control the admission of working fluid to the working chamber.

Yet another object of the present invention is to provide such displacement turbine in which the inefficiencies created by vacuum conditions developing during part throttle or other engine operating conditions are obviated.

It is a still further object of the present invention to provide a simple and highly effective sealing configuration arrangement for such engines or similar applications in which a condensing fluid such as steam is employed as a working medium.

It is yet another object of the present invention to provide a throttle valve suitable for applications in which the communication, or source of high pressure working fluid, is controlled by a slidable gate-type valving disc having an opening moving into and out of alignment with a circular port in which the wire drawing effects of the action of the high pressure fluid are minimized by the valve design.

SUMMARY OF THE INVENTION

These and other objects of the present invention, which will become apparent upon a reading of the following specification and claims, are achieved by a displacement turbine type external combustion engine in which a high pressure fluid medium is employed in conjunction with two or more, generally circular rotors, one of which is a power rotor and the other a sealing rotor disposed for rotation about parallel axis with the periphery of each rotating in tangential contact with each other. The power rotor is formed with a radially outwardly extending protuberance defining a piston which rotates within a bore formed in an engine block, with the region behind the piston acting as a working chamber.

Upon the admission of a pressurized fluid such as steam, the point of tangential contact acts as a seal. This allows the fluid pressure to act on the piston to urge the power rotor to rotate. The piston rotates into registry with an intake port just after passing the point of tangential contact whereat the piston is received into a clearance recess to admit the working fluid, and after rotating through a complete working stroke, the working chamber is in communication with an exhaust port allowing exhausting of the expanded working fluid.

The invention features the provision of an absorber tank disposed adjacent the intake port and allows a relatively large volume of working fluid under pressure to accumulate to smooth out the pressure surges caused by rapid valving action as the power rotor rotates into and out of registry with the intake port.

A pressure balancing circular groove is disposed on the one or more power rotors and on the opposite face from the intake valve opening and caused to communicate with a source of the working pressure to thereby create a pressure balance condition on the power rotor.

The working chamber is provided with a vacuum port and vacuum valve which causes the working chamber to be exhausted into the feed water make-up tank which is at atmospheric conditions upon development of a vacuum condition in the chamber. The vacuum port is located in an intermediate location in the stroke of the rotor. A further vacuum port is also provided adjacent the sealing rotor and located so as to relieve any vacuum condition developing as the piston withdraws from the recess in the sealing rotor.

A special sealing arrangement is provided on the mating faces of the rotors and the cover plate and block, in which is formed the intake valve. The sealing arrangement includes a series of shallow depressions or dimples formed in each of the adjacent faces with a slight clearance space, and which act to create a seal upon expansion of steam into the clearance space by condensation of the steam and creation of a liquid seal in the clearance space.

A special throttle valve is provided which is mounted to the absorber tank which operates as a lost motion connection in which an operating lever provided with a lost motion connection with an operating member which during the lost motion, a valving disc having a circular opening is caused to be unseated from the valve face and just prior to being rotated or displaced across a valve port in order to carry out the communication of the high pressure working fluid medium with the source of pressure in the absorber tank. The port and disc opening form an "elliptical" opening at part throttle minimizing the "wire drawing" effect.

A two power stroke version of the engine is provided by a dual piston power stroke rotor which is combined with intake ports disposed on either side of the working chamber range such as to cause pressurization of the working chamber twice during each revolution of the power rotor. A four power stroke engine is provided by the provision of a three rotor version in which two sealing rotors are provided adjacent a central power rotor. The central power rotor is provided with two 180 degree apart pistons as well as two intake ports communicating with respective intake porting recesses formed on the power rotor such that the space behind each piston defines a working chamber twice during each revolution of the power rotor and the pressurization of each working chamber provides a four power stroke engine.

BRIEF DESCRIPTION OF THE DRAWINGS

FIG. 8 is a longitudinal partially sectional view of a throttle valve arrangement employed with a displacement turbine engine according to the present invention;

FIG. 9 is an end view of the throttle valve shown in FIG. 8.

DETAILED DESCRIPTION OF THE DRAWINGS

In the following detailed descriptions, the following terminology will be employed for the sake of clarity and particular embodiments described in accordance with the requirements of 35 U.S.C. 112, but it is to be understood that the same is not intended to be limiting and indeed should not be so construed inasmuch as the invention is capable of taking many forms and variations within the scope of the appended claims.

Figure 1:
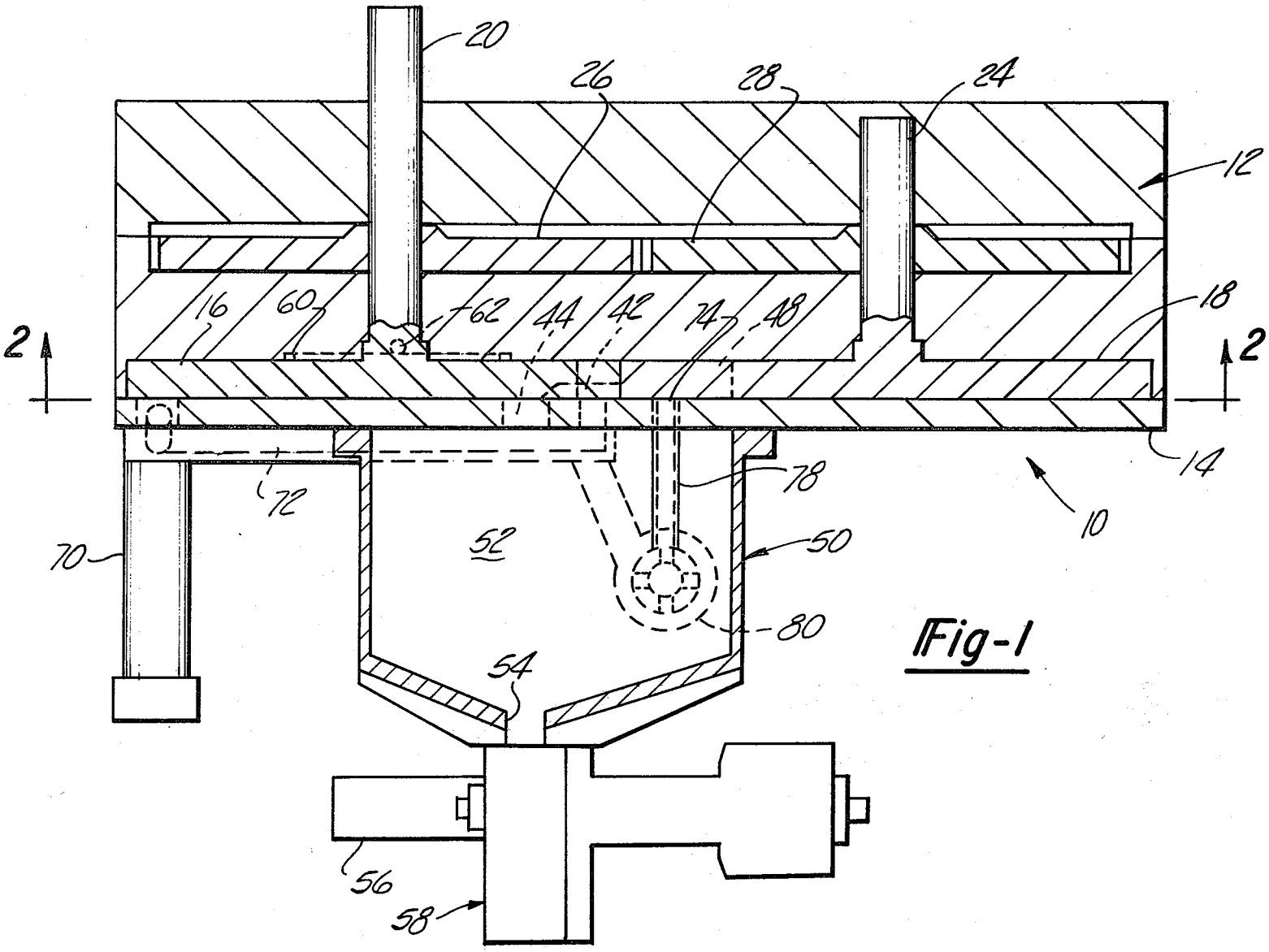
FIG. 1 is a partially sectional plan view of an engine according to the displacement turbine engine of the present invention.
Figure 2:
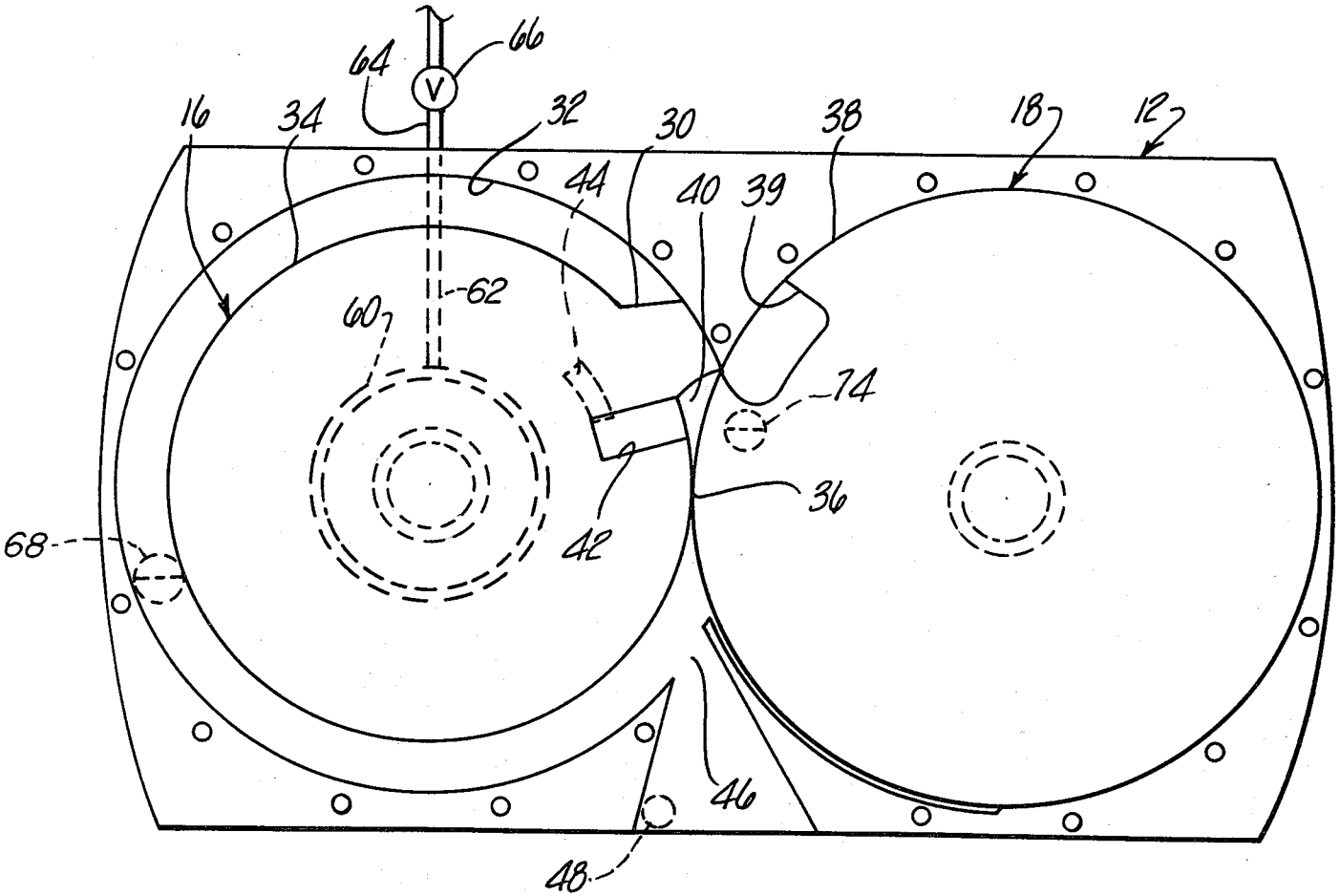
FIG. 2 is a front view of the two rotor displacement turbine engine shown in FIG. 1 with the front cover plate removed to reveal the interior details.

Referring to the drawings and particularly FIGS. 1 and 2, a displacement turbine engine 10 is depicted. This includes an engine block 12 and cover plate 14 which mounts a pair of generally circular rotors, a power rotor 16 and a sealing rotor 18, both rotatable about axes of rotation parallel to each other. The power rotor 16 is secured to an output shaft 20 while the sealing rotor 18 is secured to an idler stub shaft 24. The power rotor 16 and sealing rotor 18 are caused to rotate in synchronism with each other by mating gears 26 and 28 which are in mesh with each other and insure the rotation of the power rotor and sealing motor 18 in strict synchronism with each other.

The power rotor 16 is provided with a protuberant piston 30 extending out from the periphery. The piston 30 moves within a circular recess 32 formed in the engine block 12. The clearance space between the periphery 34 of the power rotor 16 in the recess 32 enables the formation of an expansion or working chamber defined by the space behind the piston 30 and the point of contact indicated at 36 between the outer periphery 38 of the sealing rotor 18. The contact mounting of the power rotor 16 and the sealing rotor 18 is such as to have tangential contact at one point 36, which enables a seal to be maintained throughout the rotation of the power rotor 16 and the sealing rotor 18. In the space between the piston 30 indicated at 40 the piston 30 forms an expansion chamber which will produce a net force on the power rotor 16 tending to produce counterclockwise rotation as viewed in FIG. 2.

A working fluid such as steam is admitted to the expansion chamber 40 at the proper point in the rotation of the power rotor 16 by a valving arrangement consisting of an intake valve channel 42 and an intake port 44 formed in the cover plate 14 indicated in broken lines in FIG. 2 since the cover plate is then shown removed in that figure in order to reveal the internal details. The admission of high pressure fluid or steam causes the counterclockwise rotation of the power rotor 16 which allows expansion of the steam as the volume of the expansion chamber 40 increases.

Just behind the point of contact 36, is provided an exhaust port channel 46 which enables the expanded steam to be exhausted from the expansion chamber and out through an exit port 48. The steam is almost completely expanded by the process such that a large volume of liquid water will normally be present in the exhaust.

This, of course, is a major factor in the superior efficiency of this engine and enables the engine to function largely as its own condenser, i.e., a large separate external condenser will not be required since the steam will be largely in the condensed state after passing through the displacement turbine.

According to one aspect of the invention, the high pressure working medium, or steam fluid medium, is admitted via an absorber tank 50 which is directly mounted to the cover plate 14 and which defines an interior chamber 52 of relatively large volume which is in communication with the port indicated at 44. The intake port 44 in turn communicates with the intake valve channel 42 at the appropriate point in the rotation of the power rotor 16. The absorber tank chamber 50 in turn receives the high pressure fluid via an inlet opening 54 from a high pressure source, communication from which is controlled by a throttle valve assembly 58 which may be operated under the control of a control lever as will be hereinafter described in further detail.

In order to provide pressure equalization to offset the effects of applying the high pressure working fluid medium to one face of the power rotor 16, a pressure equalization arrangement is provided which consists of a groove 60 formed in the engine block 12 and which is caused to receive high pressure fluid via an opening 62 and channel 64 in which communication may be controlled by a valve 66. This serves to admit a high pressure working fluid to the circular annular groove 60 and produces a pressure equalization such that the net fluid pressure force acting on the power rotor 16 is substantially zero.

According to another aspect of the present invention, there is provided a vacuum port 68 in communication with the recess 32 at a point approximately 180 degrees or across from the intake port 44. The vacuum port 68 is caused to be placed in communication with the exhaust port 48 by a vacuum control valve 70 which acts as a vacuum breaker arrangement to enable communication with the exhaust port 48 via a channel 72, if a low pressure, sub-atmospheric pressure condition develops behind the piston 30 due to operation at part throttle. That is, the volume of steam admitted may be such that expansion of the charge behind an expansion chamber 40 may be substantially complete after less than a full revolution of the power rotor 16, thus creating drag due to the differential pressure acting on the piston 30. This vacuum condition is alleviated by placing the expansion chamber 40 in communication with the exhaust port 48.

A similar vacuum condition can exist as the piston 30 leaves a recess 39 formed in the periphery of the sealing rotor 18. For this reason, an additional vacuum port 74 is provided which has a controlling channel 78 extending into communication with a secondary vacuum valve 80 which similarly places the additional vacuum port 74 in communication with the exhaust port 48 if a vacuum condition develops. Such valves are a well known design in themselves, and open upon development of a vacuum pressure. Such valves are commonly known and employed in vacuum breaking type valves which serve to create a sealing of the respective vacuum relief ports except when a vacuum condition exists in the working chamber.

Accordingly, the vacuum is alleviated by communication with the atmospheric pressure existing in the exhaust port, and the drag acting on the displacement turbine is thereby substantially eliminated.

Figure 3:
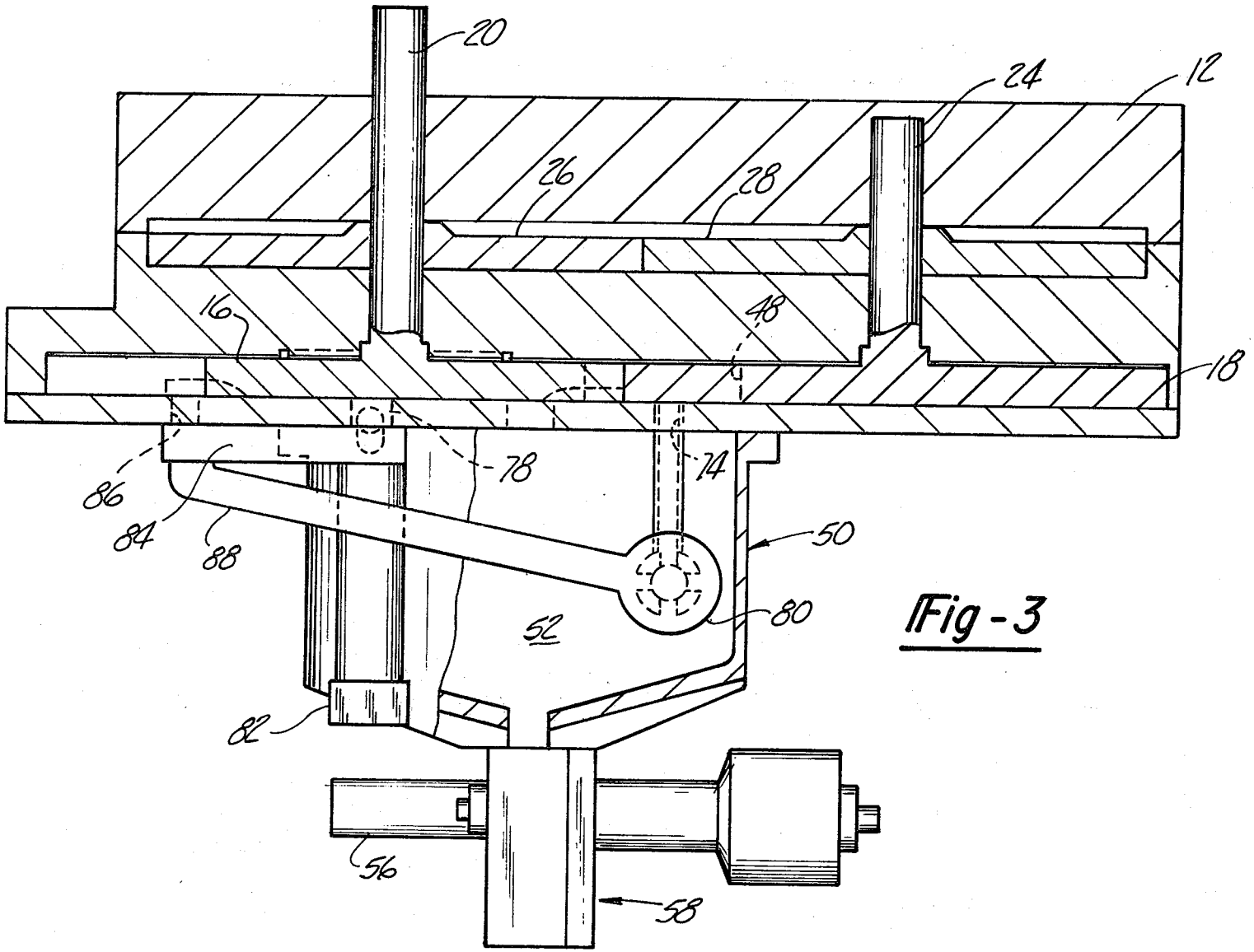
FIG. 3 is a two rotor two power stroke alternate version of the displacemet turbine engine depicted in FIGS. 1 and 2.
Figure 4:
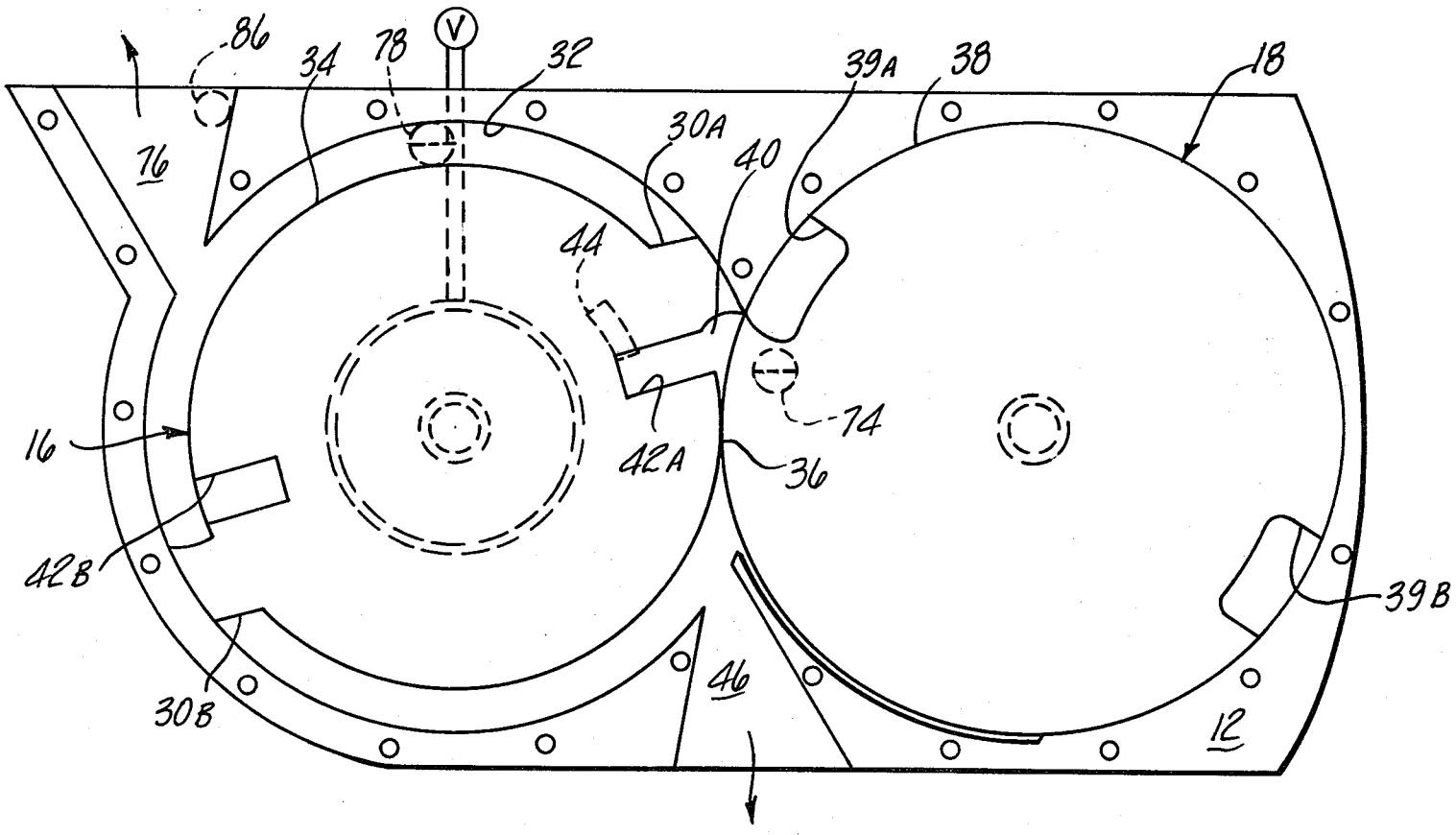
FIG. 4 is a front view with the cover removed of the two power stroke displacement turbine engine shown in FIG. 3.

In FIGS. 3 and 4, an alternate embodiment is depicted which provides for two power strokes per revolution of the power rotor 16. This provides a higher power output of the engine. The additional power stroke is provided by configuring the power rotor 16 with a pair of diametrically oppositely located pistons 30*a* and 30*b* and a pair of intake channels 42*a* and 42*b* which alternately come into registry with the intake port 44. An additional exhaust port 76 is provided which is much nearer to the point whereat the expansion chamber 40 is pressurized. As the piston 30*a* rotates under the action of the pressurized fluid entering the expansion chamber 40 after registry of the channel 42*a*, the power rotor 16 rotates counterclockwise moving the piston 30 A past the exhaust port 76. At this point, the other intake channel 42*b* comes into registry with the intake port 44 to repressurize the space behind the piston 30*b* and cause an additional working or power portion of the stroke. Thus, two pressure pulses or power strokes are imposed on the power rotor 16 as the power rotor 16 completes one cycle of rotation.

A pair of piston recesses 39*a* and 39*b* are provided in the sealing rotor 18 to accommodate the respective piston 30*a* and 30*b*.

In this version, a suction port 78 is provided intermediate the circumferential distance between the port location and the exhaust port 76 location. The primary vacuum relief valve 82 controls the communication of the vacuum release or suction port 78 with a cross channel 84 in communication with a suction port 86 disposed in the exhaust port 76 in order to provide releasing of the vacuum that develops in the expansion chamber 40 during operation at part throttle.

Similarly, the secondary vacuum valve 80 controls communication with the suction port 74 disposed in the cover plate 14 adjacent the point whereat the pistons 30*a* and 30*b* approach the respective recesses 39*a*, 39*b* in order to eliminate that vacuum and are similarly placed in communication by a cross tube 88 with the suction port 86. The other components are identical to the version depicted in FIGS. 1 and 2, i.e. the throttle valve 58, the accumulator absorber chamber tank 50, as well as the mating gears 26 and 28 are provided to insure synchronized rotation of the power rotor 16 and sealing rotor 18.

Figure 5:
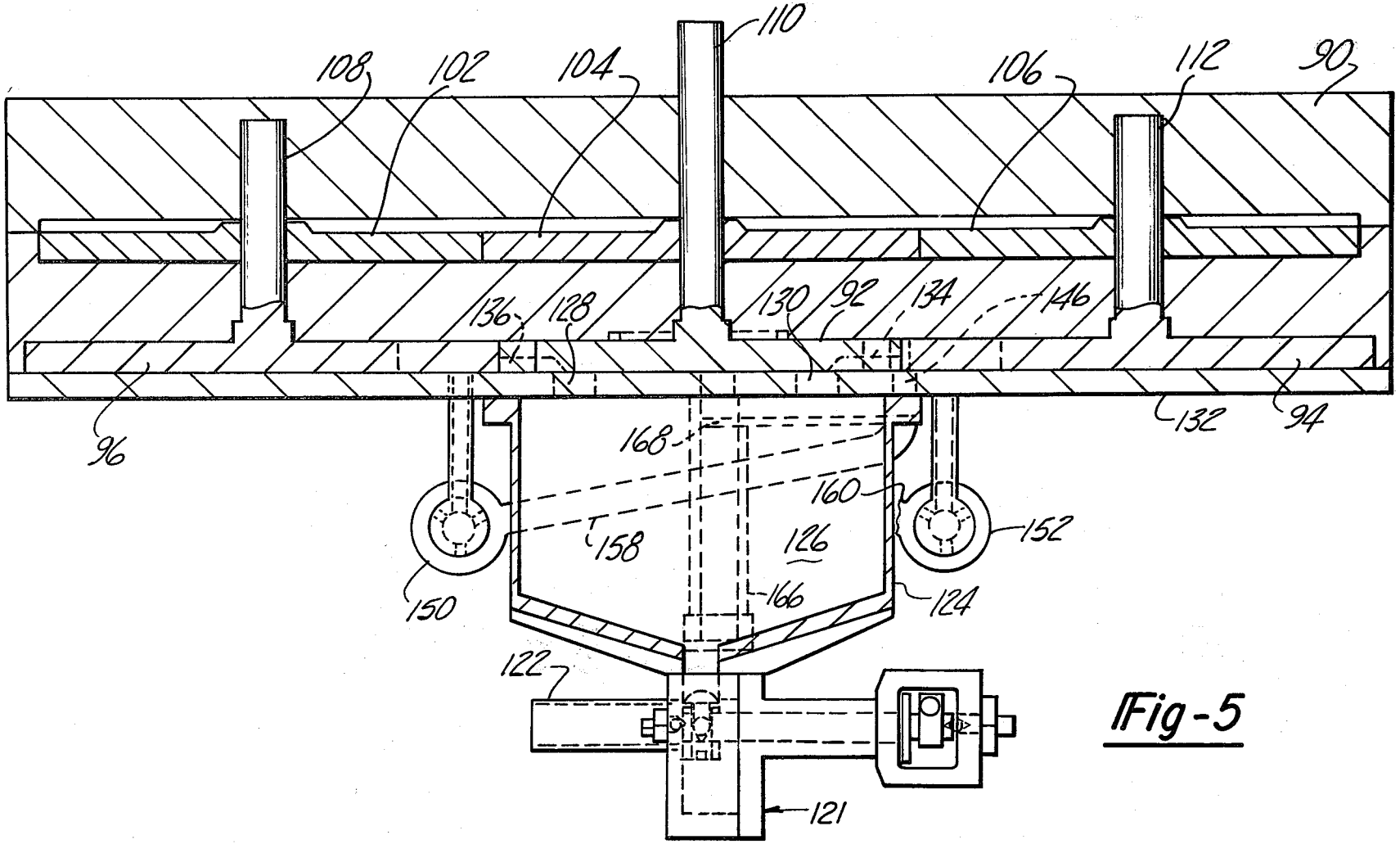
FIG. 5 is a partially sectional plan view of a three rotor four power stroke displacement turbine engine according to the present invention.
Figure 6:
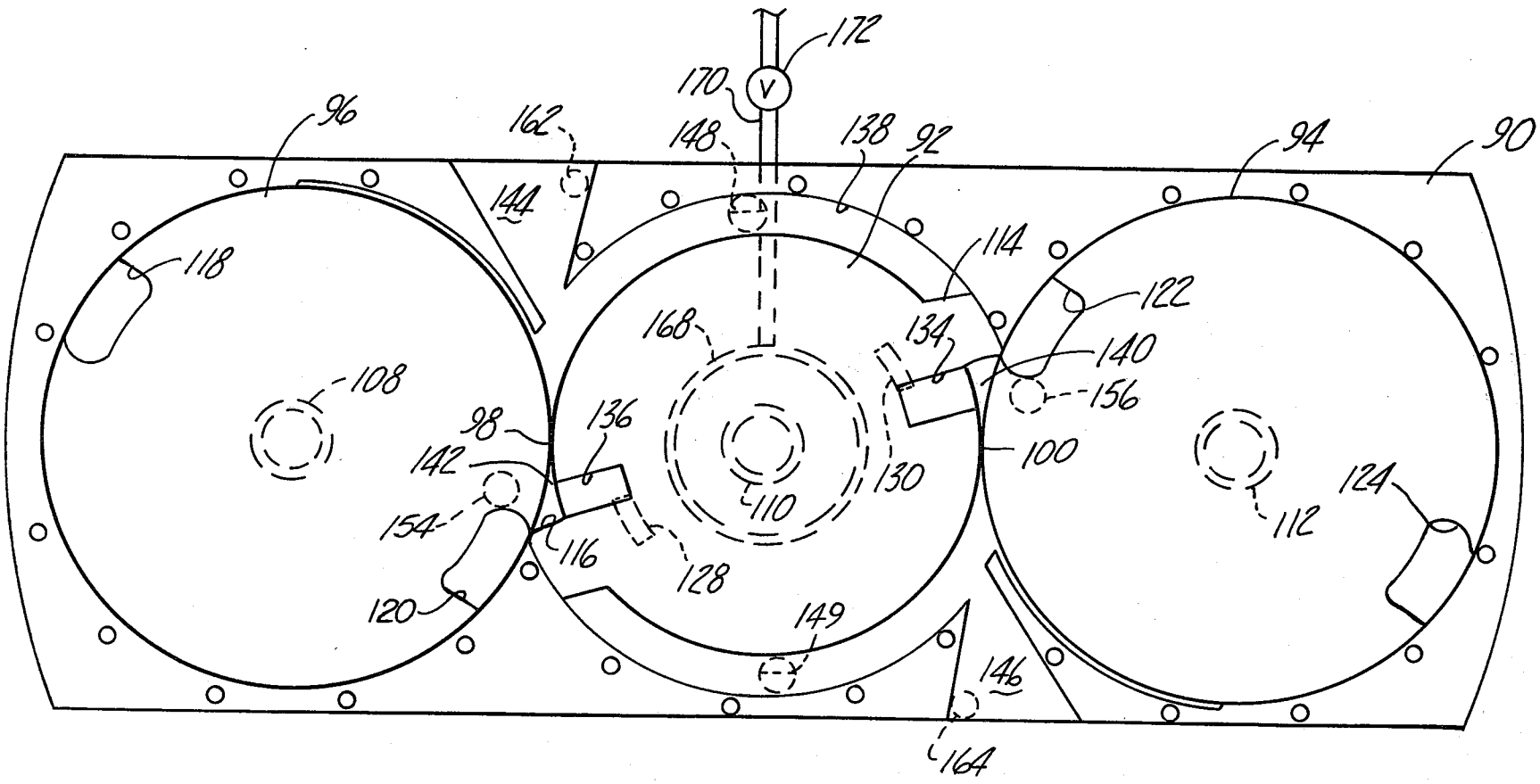
FIG. 6 is a front view with the cover removed of the three motor embodiment depicted in FIG. 5.

A further increase in the number of power pulses per revolution is provided by a three rotor design as depicted in FIGS. 5 and 6. In this design, an engine block 90 mounts a central power rotor 92 and a pair of sealing rotors 94 and 96, with each being mounted about a parallel axis and disposed adjacent each other such as to provide a point of tangential contact 98 and 100 between the power rotor 92 and the sealing rotors 94 and 96 respectively. The synchronizing gears 102, 104 and 106 are provided which are drivingly connected to the sealing rotor 96 and, the power rotor 92 respectively. The stub shaft 108 connects the sealing rotor 96 to the synchronizing gear 102, connects the power output shaft 110 connecting power rotor 92 to the synchronizing gear 104 and the stub idler shaft 112 connects the sealing rotor 94 to the synchronizing gear 106. This arrangement, as in the other embodiments, insures synchronous rotation in order to insure that the pistons 114 and 116 move into corresponding recesses 118 and 120, on the sealing rotor 96 and 122 and 124 on the sealing rotor 94.

A throttle valve assembly 121 is provided which controls flow of steam from a source of high pressure steam received via the intake tube 122 into an absorber tank 124, having a large internal volume cavity chamber 126 for purposes as described in the above embodiment. The interior chamber 126 of the absorber tank 124 is in communication with a pair of intake ports 128 and 130 formed in a cover plate 132 which is mounted to the engine block 90. Each of the intake ports 128 and 130 are moved into registry with respect to the intake channels 134 and 136 formed on opposite sides of the power rotor 92. The power rotor 92 is disposed in a chamber 138 formed in the engine block 90, to thereby define an expansion chamber 140 each behind each respective piston 114 and 116 and the corresponding points of sealing contact 98 and 100. Oppositely located exhaust ports 144 and 146 are also provided as well as opposite vacuum releasing suction ports 154 and 156 formed on the cover plate 132, indicated in broken lines on FIG. 6 as are the intake ports 128 and 130. In this embodiment, a pair of primary vacuum relief valves 150 and 152 are provided which provide the communication with a pair of suction ports 154 and 156 respectively, which are formed in the cover plate 132 and which serve to eliminate a vacuum condition created as the respective pistons 114 and 116 exit the recesses 120, 118, 122 and 124 formed in the sealing rotors 96 and 94 respectively. This establishes communication with the exhaust port via the cross channels 158 and 160 with the exhaust port 146. Suction ports 162 and 164 are provided associated with the cover plate 132 associated with the respective exhaust ports 144 and 146 respectively.

Also provided is the secondary vacuum relief ports 148 and 149 as noted which are caused to be placed into communication with the suction port 164 by means of a vacuum relief valve 166 and a cross channel 168.

A pressure equalizing ring recess 168 is provided and placed in communication with a source of high pressure working fluid medium via a line indicated diagramatically at 170 under the control of a valve 172 with the absorber tank in order to place the opposite face of the power rotor 92 under a counterbalancing fluid pressure force exerted on the face within which the intake ports are formed.

Accordingly, four power strokes per revolution will be realized by this arrangement as each piston passes a respective intake port 128 and 130. The space behind the respective sealing points 98 and 100 will be pressurized causing the power rotor 92 to be rotated counterclockwise and the sealing rotors 94 and 96 to be rotated clockwise in synchronism therewith. As each piston passes a respective exhaust port 144 and 146, the expanded fluid is exhausted. Such a cycle takes place four times during each revolution of the power rotor 92 to thus increase greatly the power output of the displacement turbine according to this particular design. As developed above, the throttling of high pressure fluid medium via a small diameter orifice creates an energy loss in the system due to the so called "wire drawing" effect in which the constriction of the orifice causes an expenditure of energy and resultant loss of efficiency of the engine. Accordingly, a particular throttle valve design is depicted herein in FIGS. 8 and 9 in which the wire drawing effect is held to a minimum by generating an elliptical throttling opening. This elliptical opening is produced by a circular valving opening 180 formed in a swingably mounted valving disc 182 which is mounted within the throttle valve housing 58. The throttle valve housing 184 has a mounting flange 186 adapted to be mounted directly to the absorber tank 50 with an inlet to 188 adapted to be connected to a source of steam such as a steam boiler, not shown in the drawings.

The position of the valving disc 182 brings the circular valving opening 180 into and out of registry with the internal bore 190 formed in the throttle valve housing 184 with the degree of registry producing the throttling effect. It can be seen from FIG. 9 that the shape of the opening at part throttle conditions is very roughly elliptical, indicated at 192, which produces a reduction in the wire drawing effect and a decrease in the pressure losses flowing through such an elliptical shaped opening. The position of the valving disc 182 is controlled by a valve operating mechanism which enables a pressure sealing of the valve in the closed position but which minimizes the effects of pressure on the valving disc 182 during operation. This includes a throttle lever 194 which is pivotally mounted about a pivot bearing 196 and which is formed with a threaded stub shaft 198 and is threadedly received in a corresponding threaded bore in a disc lever 200. The disc lever 200 and the throttle lever 194 have a lost motion driving connection established by a pair of disc lever adjusting screws 202, 204 carried by gussets 205 of the disc lever 200 and a stop block 206 fixed to the throttle lever 194 with an adjustable clearance space therebetween. Upon movement of the throttle lever 194, in the first direction, the threaded stub shaft 198 and the corresponding threaded bore are relatively rotated to cause the disc lever 200 to be axially advanced. The valving disc 182 is formed with an operating valve shaft 208 which is keyed at 210 to the disc lever 200 so as to rotate together therewith and upon movement of the disc lever 200 to the left as viewed in FIG. 8, the valve disc is unseated thus eliminating the friction caused by fluid pressure acting on the closed valving disc 184. A further movement of the operating lever 194 causes contact of the lower disc lever adjusting screws 202 and 204 with the stop block 206 to thus rotate the valving disc 182 and the valving opening 180 into or out of registry with the through passage 190.

In order to partially offset the effects of pressure, a partially arcuate recess groove 212 is provided in the valve housing 184 and which is in communication with the source of high pressure fluid medium via tube 214 and valve 216 to thus minimize the effects of pressure. By closing the valve, the valving disc 182 is again seated and the high pressure fluid creates a sealing closure against the valve seat. A return spring 218 is provided which urges the throttle lever 194 to a position corresponding to the valve closed position.

Figure 7:
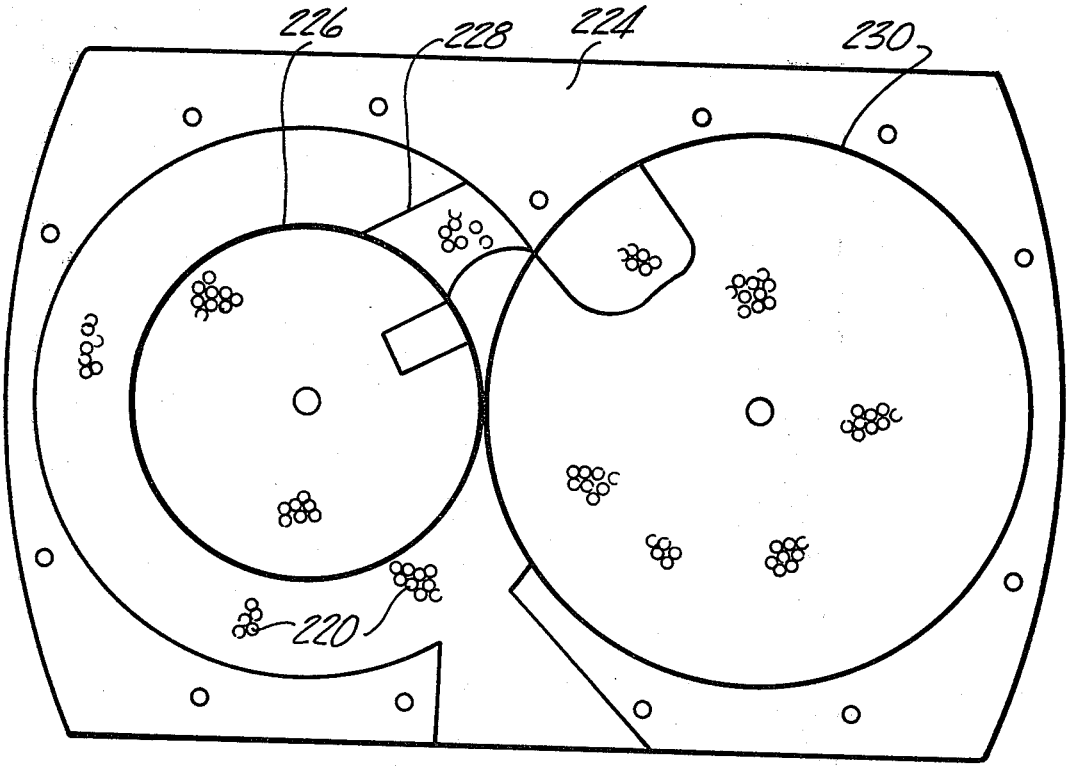
FIG. 7 is a view of the sealing surface treatment of the mating surfaces on the rotor housing and cover plate.

As developed above, a primary problem in the efficient operation of this type of engine is the proper sealing between the power and sealing faces and the respective cover plate and engine block members of the engine since considerable leakage of fluid past these faces would seriously degrade the efficiency of the engine. It has been discovered by the present inventor that a very effective seal can be achieved for high pressure steam as a fluid or vapor as the operating medium by the formation of a particular surface treatment of the mating faces which is relatively simple and introduces no metal to metal contact but which produces very effective sealing. This surface treatment is indicated in FIG. 7 and includes the formation on the mating faces of the working parts of the engine of a series of small shallow dimples or depressions indicated at 220 in the engine block 224 corresponding to holes on the underside of the power rotor indicated at 226 and a piston 228 as well as on the mating face, the power of the sealing rotor 230 and also on the underside of the cover plate (not shown in FIG. 7). A small running clearance is left between these respective mating surfaces, i.e., on the order of 0.001 to 0.0025 inches. The presence of the relatively small diameter depressions, i.e., on the order of 0.003 to 0.029 of an inch in diameter and about 0.03125 of an inch depth, produces, it is believed, a tendency for the steam to condense upon expanding into slight openings, producing a liquid seal which is maintained by the liquid cohesion in the slight running clearance. This effect has been proven by an actual tryout of the engine according to the corresponding engine with steam and this indicates an effective seal produced by such surface treatment produced for condensable fluid pressure working mediums such as steam. The surface treatment may be produced by machine or other suitable fabrication techniques and may be produced with modest cost, and which introduces no running friction such as to maintain the high efficiency of the engine. The mating surfaces are also not subject to wear since metal to metal contact is not involved in the sealing.

It may be appreciated that the engine according to the present design realizes the potential advantages of this general type of engine, i.e., being external combustion, any fuel that can produce steam or vapor is suitable for use with this engine. The rotary motion produces a smoothness and freedom from vibration as well as extreme durability and ease of maintenance. This is further contributed to by the simplicity of design which has very few moving parts. The particular design also realizes the advantages of the steam engine in that a large reduction gear box is eliminated while providing extremely fast acceleration, quick deceleration, high torque and good lugging power at low rpm and as well as at high rpm. The particular displacement turbine engine has extremely good efficiency at full and part loads and eliminates the need for a large separate condenser. The particular design improvements of the present invention have corrected the disadvantages of previous attempts at this type of engine, i.e., the pressure unbalanced condition due to valve porting on one face of the power rotors and the elimination of the vibrations and accelerations associated with the rapid valving action of the admission of steam into the working chamber. The elimination of the effect of partial vacuum condition and drag generated at part throttle conditions has been eliminated by the primary and secondary valving arrangements described. The provision is of a much improved throttle valve design which minimizes the effect of the wiring drawing on the efficiency of operation of the engine. Finally, the sealing arrangement, while being extremely simple and durable and low in cost to fabricate, works in a highly effective manner without introducing high friction loads and consequent degradation of engine operating efficiency.

It can thus be appreciated that the above recited objects of the present invention are realized by the particular designs described herein.

What is claimed is:

1. A displacement turbine engine of the type including a rotatably supported power rotor of generally circular shape and having at least one peripheral piston formed thereon, and a sealing rotor of generally circular shape and means mounting said power and sealing rotors with a point of tangential contact with each other; said sealing rotor being formed with a piston recess receiving said piston as said power rotor rotates; and further including an engine block having a cylindrical recess receiving said power rotor for rotation therein with said piston adjacent the periphery thereof to form an expansion chamber space intermediate said piston and said point of tangential contact; intake valve means for admitting a working fluid under pressure into said expansion chamber space immediately after said piston is rotated out of said recess; and exhaust valve means exhausting said admitted fluid pressure prior to said piston again reentering said recess, the improvement comprising:

primary vacuum relief valve means responsive to development of a subexhaust pressure in said exhaust chamber space to place said expansion chamber space in communication with exhaust pressure while said expansion chamber space is expanding as said piston recess receives said piston, said primary vacuum relief valve means continuing communication with said expansion chamber space while said piston travels in said recess, said primary vacuum relief valve means further terminating communication with said expansion chamber space after said piston is rotated out of said recess and prior to admitting said working fluid into said expansion chamber space, whereby drag produced by development of said subexhaust pressure is avoided.

2. The displacement turbine engine according to claim 1 further comprising secondary vacuum relief valve means disposed in communication with a point adjacent said power rotor at the point after said piston moves out of registry with said piston recess whereby a vacuum condition developing at said point is relieved by communicating said vacuum condition with exhaust pressure.

3. The displacement turbine engine according to claim 2 wherein said secondary vacuum relief valve means includes a vacuum port located intermediate said intake valve means and said exhaust valve means.

4. The displacement turbine engine according to claim 1 wherein said primary vacuum valve means comprises a port entering into said expansion chamber space; passage means connecting said port with said exhaust valve means; and valve means controlling said communication therebetween to establish communication between said vacuum relief port and said exhaust valve means only upon development of said subexhaust pressure in said expansion chamber space.

5. The displacement turbine engine according to claim 1 wherein said intake valve means comprises intake valve port means located adjacent a face of said power rotor and further including an intake channel means formed on said power rotor and moving into registry thereof to establish fluid communication to introduce said working fluid pressure into said expansion chamber space and further including a pressure equalizing means introducing said working fluid pressure against the opposite face of said power rotor means whereby said pressure exerted on said power rotor means by action of said intake valve means is counteracted by said pressure equalizer means.

6. The displacement turbine engine according to claim 5 wherein said pressure equalizer means comprises a recess groove formed in said engine block and further including means introducing said working fluid pressure into said equalizer groove.

7. The displacement turbine engine according to claim 6 further including an absorber tank including an enclosed volume receiving said pressurized fluid in communication with said intake port means whereby said absorber tank provides a pressure accumulating action decreasing the pressure surges and resultant accelerations as a result of rapid action of said intake valve means.

8. The displacement turbine engine according to claim 1 further comprising throttle valve means in controlling communication introduction of said working pressurized fluid in said intake valve means, said valve means comprising a central passage and a valving disc having a circular valve opening formed therein, said valving disc being movable into and out of registry with said central passage and controlling communication with said intake valve means, said central passage being substantially circular and further comprising valve operating means moving said valving disc into and out of registry with said central passage whereby an elliptical opening is formed by said valving disc being in partial registry with said substantially circular central passage thereby reducing the pressure loss due to throttling through said elliptical opening.

9. The displacement turbine engine according to claim 1 wherein said power rotor and said sealing rotor are rotatably mounted within said engine block and further including an engine cover disposed over one opposite face of said sealing rotor and said power rotor respectively, and further including sealing means comprised of a series of small depressions formed into said mating faces of said power rotor and said sealing rotor and said engine block and said engine cover plate respectively.

10. The displacement turbine engine according to claim 9 wherein said small depression are formed entirely over said surfaces and wherein said surfaces are disposed with a slight running clearance on the order of 0.001–0.0025 inch.

11. This displacement engine according to claim 10 further including a source of steam under pressure whereby steam comprises said pressurized working fluid.

12. The displacement turbine engine according to claim 1 further includes a second piston formed on the periphery thereof and spaced apart from said first mentioned piston whereby two power strokes are provided.

13. The displacement engine turbine according to claim 1 wherein said power rotor means further includes a second peripheral piston located diametrically opposite said first mentioned piston and wherein, said engine further includes a second sealing rotor of a generally circular configuration and formed with a corresponding recess located to move into registry with said first and second pistons wherein said first sealing rotor is also provided with a second recess moved into registry with said second piston upon rotation of said power rotor and said sealing rotor and further including intake valve means introducing pressurized fluid into the intermediate space between said point of tangential contact between said second sealing rotor and said power rotor and as either of said pistons exit said recesses whereby four power strokes per revolution are provided.

* * * * *